United States Patent [19]

Kämmerling et al.

[11] 4,249,723

[45] Feb. 10, 1981

[54] COOLING DEVICE FOR SMELTING PLANTS

[75] Inventors: Bruno Kämmerling, Dinslaken; Axel Kubbutat, Oberhausen, both of Fed. Rep. of Germany

[73] Assignee: Gutehoffnungshütte Sterkrade Aktiengesellschaft, Oberhausen, Fed. Rep. of Germany

[21] Appl. No.: 47,043

[22] Filed: Jun. 11, 1979

[30] Foreign Application Priority Data

Jun. 14, 1978 [DE] Fed. Rep. of Germany ..... 2825932

[51] Int. Cl.[3] ..... F27B 1/24

[52] U.S. Cl. ..... 266/193; 266/241; 122/6 B; 165/168; 432/238

[58] Field of Search ..... 266/190, 46, 241, 193, 266/24; 165/168; 432/238; 122/6 B; 13/32

[56] References Cited

U.S. PATENT DOCUMENTS

| | | | |
|---|---|---|---|
| 3,379,427 | 4/1968 | Zherebin et al. | 266/190 |
| 3,652,070 | 3/1972 | Sagara | 266/46 |

*Primary Examiner*—M. J. Andrews

*Attorney, Agent, or Firm*—Toren, McGeady and Stanger

[57] ABSTRACT

A cooling device for use with a refractory lining in a smelting plant, such as a blast furnace and particularly a shaft furnace, includes an inner refractory lining, an outer steel jacket, and a plate member located between them. Preferably, the plate member is cast and anchoring members are cast into each plate member and extend only from the plate member surface facing toward the steel jacket. The anchoring member secures the steel jacket and plate members together and also holds them in spaced relation. Various embodiments of anchoring members can be used. In one embodiment a blind bore is provided within the anchoring member and a thermocouple extends into the blind bore from the steel jacket for measuring the operating temperature of the plate member.

17 Claims, 5 Drawing Figures

COOLING DEVICE FOR SMELTING PLANTS

SUMMARY OF THE INVENTION

The present invention is directed to a cooling device for use in a smelting plant, such as a blast furnace and particularly a shaft furnace. The furnace wall includes a refractory layer lining the interior of the furnace, a steel jacket forming the exterior surface and plate members positioned between the refractory layer and the steel jacket. A cooling medium is circulated through the plate members. In particular, the invention is directed to fastening means for securing the plate members to the steel jacket.

A cooling arrangement of this general type has been known, for example, as disclosed in the German Offenlegungsschrift No. 14 33 332. In that arrangement, the plate elements include cast-in pipes for circulating the cooling medium. The plate elements are fastened on the steel jacket of a blast furnace and are disposed in spaced relation from the inwardly facing side of the steel jacket. The plate elements are held in place by four screw bolts. Each bolt extends from the side of the plate element adjacent the interior of the furnace, through a cutout in the plate element with the bolt heads being countersunk. The cutouts are either cast-in or bored through the plate elements. The outer ends of the screw bolts extend through knockouts in the steel jacket and nuts are screwed onto the outwardly projecting end portions. When the nuts are threaded on the bolts, the plate elements are pulled toward and fastened to the steel jacket. The spacing between the plate elements and the steel jacket is maintained by appropriately arranged brackets.

Due, on one hand, to the high temperature in the interior of the blast furnace, and on the other hand, to the sinking of the charge, the furnace side of the plate elements through which the cooling medium flows, is subject to significant loads. Initially, during wear on the refractory lining protecting the plate elements, these loads are experienced as indirect stress and, finally, after the lining is worn away, the loads are felt as direct stress. Subsequently, since such a condition inevitably occurs after a certain period of operation, there is the result that the heads of the screw bolts are subjected directly to these high loads. As a result, the heads of the screw bolts wear relatively quickly and lose their fastening capability. Due to such wear, the plate elements are no longer supported from the steel jacket and their service life ends prematurely.

It would be possible to countersink the heads of the screw bolts more deeply into the plate elements and, at the same time, use highly heat-resistant materials for the screw bolts. Such measures, however, do not eliminate the existing disadvantages, rather they only cause an insignificant, that is, absolutely insufficient, increase in the service life of the plate elements. Moreover, effecting a deeper countersinking of the screw bolts in the plate elements has the disadvantage that heat flow to the cooling pipes located with the plate elements is significantly disturbed at such locations and locally higher operating temperatures of the plate elements will develop.

Finally, in this known cooling arrangement there is the further disadvantage that, at least in the regions of the screw bolts which serve to secure the plate elements in position, the refractory lining on the furnace side can only be mounted after the plate elements are assembled with the results that the assembly is more cumbersome.

Therefore, the primary object of the present invention is to provide a cooling device of the same general type in which the service life of the plate elements corresponds to the precalculated service life of such elements affording a satisfactory cooling function while providing a more efficient assembly.

In accordance with the present invention, the disadvantages experienced in the past are avoided by providing anchoring members secured to the plate members with the anchoring members extending only from the outwardly facing surfaces of the plate members toward the steel jacket.

By combining the fastening means with the plate members so that they form a part of the plate members it is possible to secure the plate members to the steel jacket so that, initially, the service life of the plate members can be made the same as the wear of such members due to the furnace conditions. Since the fastening members are no longer subject to wear stress because of furnace conditions, the negative effect previously experienced is avoided. Accordingly, the fastening members will retain their fastening capabilities until the normal wear experienced by the plate members because of furnace conditions, terminates their usefulness. Furthermore, since the fastening members are accessible only from the outside surface of the steel jacket, there is the significant advantage that the refractory layer on the plate members which lines the furnace interior, can be placed even before the assembly of the plate members without concern for the fastening members so that an efficient assembly of the entire arrangement is possible.

In a preferred embodiment of the invention, the fastening members each include a spacer lug extending between the plate member and the adjacent surface of the steel jacket. As a result, the spacer lugs not only provide a separation between the inner surface of the steel jacket and the plate members so that a heat-insulating material can be filled into this intermediate space, but, since they form a part of the plate members, they afford a fastening function for the plate members. Therefore, additional fastening means are not required.

In accordance with the invention, it may be advantageous to provide the outer end portions of the spacer lugs as threaded shanks which extend at least partially through openings in the steel jacket. Such threaded shanks have a smaller cross-section than the inner portions of the spacer lugs so that they can project through and outwardly from the outwardly facing surface of the steel jacket. Accordingly, nuts can be screwed on the threaded shanks for pulling the plate members toward the inwardly facing surface of the steel jacket. The spacer lugs provide the desired spacing between the plate members and the steel jacket as determined by the length of the lugs inwardly of the threaded shank. It is also possible to provide the reduced diameter end portions of the spacer lugs so that they are not threaded over the entire length. Moreover, the end portions which are not threaded can be provided with a larger cross-section of approximately the diameter of the openings through the steel jacket so that they provide a centering function.

Another feature of the invention involves the provision of a blind bore extending into the spacer lugs from the outer ends of the fastening members. Such bores can be used for inserting a securing part of the fastening member.

Further, the interior of the blind bore can be threaded so that a fastening screw or bolt can be screwed into the bore. In such an arrangement, the fastening screws are screwed into the internal threads from the outer side of the steel jacket with the screws extending through suitable openings in the jacket. As a result, the plate members are pulled toward the inner side of the steel jacket with the spacer lugs affording the desired spacing. The screws may be stud bolts or cap screws. Since they are located on the exterior part of the furnace enclosure, it is not necessary to use screws of highly heat-resistant materials. For example, it would be possible to use conventional screws with hexagonal heads, which are normally available, as the fastening screws for the plate members.

When the spacer lug portion of the fastening members are provided with internal threads, another optional feature of the invention is that the blind bore can extend inwardly from its threaded portion. In such a construction, the extended part of the bore has a smaller cross-section than the threaded portion and extends into the region of the plate members through which the passageways for the cooling medium traverse extend. Accordingly, thermocouples can be inserted into the blind bores into the region of the cooling agent passageways for measuring the operating temperature of the plate members. Such a feature affords the significant economical advantage that it is not necessary to include connecting pieces into the plate members for measuring the operating temperature or to provide additional armored through-openings for the thermocouples. Additionally, sealing difficulties which would ordinarily result, are eliminated.

It may also be advantageous where the fastening member includes a blind bore to provide a bore through the fastening screws. With such an arrangement, the thermocouples can be easily inserted directly through the fastening screws.

When cast plate members are used, particularly cast iron plates, in a preferred embodiment of the invention the fastening members are formed by casting them into the plate members on the side which faces the steel jacket. The fastening members include the anchoring part extending into the plate member and the spacer lug extending toward the steel jacket. Accordingly, the spacer lugs are not formed of the same material as the plate members. In casting the anchoring portions of the fastening members into the side of the plate members facing the steel jacket, it is ensured that the plate members are secured to the steel jacket for their full intended service life, since the fastening members including any fastening attachments are no longer subject to wear resulting from the conditions within the furnace.

To increase the interengagement of the fastening members to the plate members, the anchoring portion of the fastening members within the plate members are provided with annular shaped lands and grooves which provide an interlocking engagement with the plate members. These alternating lands and grooves ensure a problem-free attachment of the fastening members into the plate members.

Finally, an especially advantageous feature of the invention involves the provision of a metallic coating on the anchoring parts of the fastening members within the plate members. The metallic coating forms carbides during the casting procedure. Such a coating placed between the anchoring parts of the fastening members and the plate members, prevents carburization and, thus, any embrittlement of the anchoring material. At the same time, the strength of the interlocking engagement between the plate members and the fastening members is increased. The metallic coating can be chromium. By the use of this feature the diffusion of carbon into the anchoring portion of the fastening member is prevented and, in addition, a good heat transfer is assured.

The various features of novelty which characterize the invention are pointed out with particularity in the claims annexed to and forming a part of this disclosure. For a better understanding of the invention, its operating advantages and specific objects attained by its use, reference should be had to the accompanying draiwngs and descriptive matter in which there are illustrated and described preferred embodiments of the invention.

DETAIL DESCRIPTION OF THE INVENTION

Figure 1:
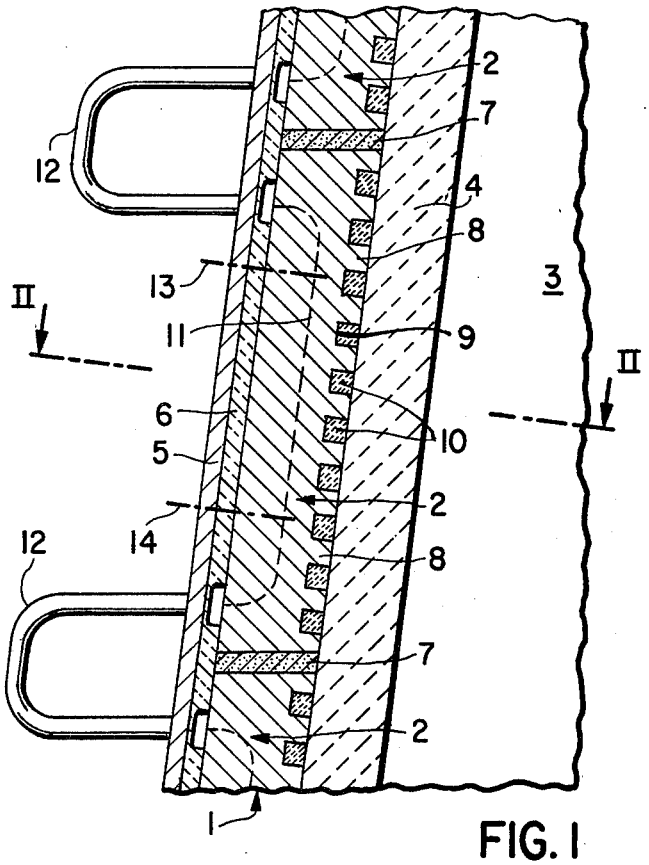
FIG. 1 is a vertical sectional view through an upper portion of a blast furnace wall including a cooling device integrated into the blast furnace wall.
Figure 2:
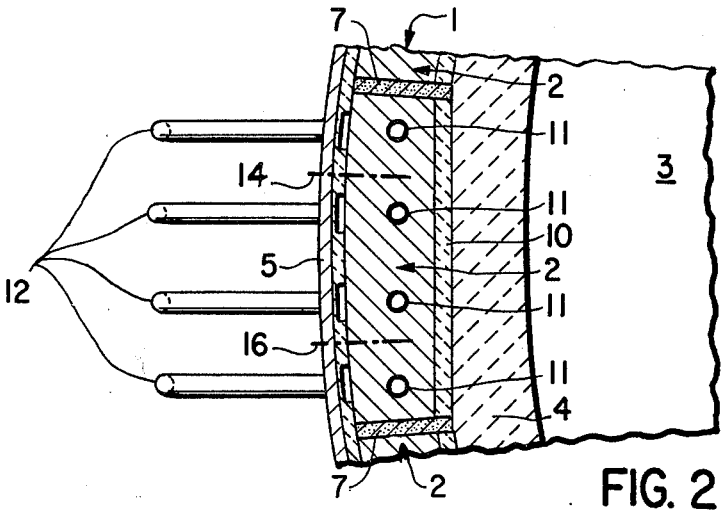
FIG. 2 is a horizontal sectional view of a sector of the blast furnace wall and the cooling device of FIG. 1, taken along the line II—II in FIG. 1.

In FIGS. 1 and 2 a cooling device is shown incorporated into a blast furnace wall 1 and includes a plurality of plate elements 2 arranged next to one another in both the circumferential and vertical directions of the furnace wall. In FIG. 1, the plate elements are shown positioned one above the other while in FIG. 2 the plate elements are arranged in side by side relation in the circumferential direction of the furnace wall. A refractory layer 4 lines the surface of the furnace interior 3 and a steel jacket 5 defines the outside surface of the furnace wall. The plate elements 2 are located between the refractory layer 4 and the steel jacket 5 while the plate elements contact the radially outer surface of the refractory layer 4. A layer 6 of heat insulating material separates the outer surfaces of the plate elements and the inner surface of the steel jacket.

The vertical and horizontal spaces between adjacent plate elements 2 are sealed by an appropriate cement 7. The inwardly facing surfaces of the plate elements 2 have alternating lands 8 and grooves 9, note FIG. 1. Another refractory material 10 is filled into the grooves 9.

Plate elements 2 are formed of cast iron and have vertically extending cooling pipes 11 extending through them, note the phantom line in FIG. 1 representing the vertical run of the pipes while in FIG. 2 the position of the pipes within the plate elements is indicated. The pipes 11 are spaced between the outwardly and inwardly facing surfaces of the plate elements. In the vertical direction of the blast furnace wall 1, the cooling pipes in adjacent plate elements 2 are connected to one another by pipe bends 12 which are located exteriorly of the steel jacket 5.

To maintain the clarity of the drawing, in FIGS. 1 and 2 the attachment locations of the plate elements 2 and the steel jacket 5 are shown only by the dash-dot lines 13–16. The fastening means used, however, are explained in detail below.

Figure 3:
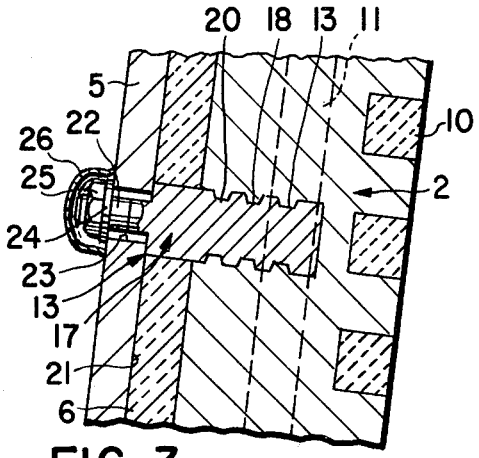
FIG. 3 is a vertical sectional view, on an enlarged scale, of a first embodiment of a fastening member of the cooling device.

One embodiment of a fastening means 13 is shown in FIG. 3 in which the plate element 2 is attached to the steel jacket 5 by an anchoring member 17 in the form of a steel bolt which is cast directly in the plate member when it is produced. The transverse cross-section of the anchoring member may be round or rectangular. To provide better interengagement between the anchoring member and the plate member, alternating annular shaped lands and grooves 18 are provided on the interface between the anchoring member and the plate member. These lands and grooves provide an improved interengagement of the fastening means with the plate member. Further, the surface of the anchoring member in contact with the plate member is provided with a metallic coating 19, for example, a coating of chromium, which during the casting procedure forms carbides preventing the diffusion of carbon into the anchoring member material. This carbide layer avoids embrittlement of the anchoring member material.

The portion of the anchoring member 17 projecting outwardly from the plate member toward the steel jacket forms a spacer lug 20 and the outer transverse surface of the spacer lug contacts the inner side 21 of the steel jacket 5. The spacer lug portion 20 provides the desired spacing between the outer surface of the plate element 2 and the inner surface 21 of the steel jacket 5. While the spacer lug portion 20 has the same outside diameter as the anchoring member within the plate element, a threaded shank 22 projects outwardly from the outer end of the spacer lug portion 20 and extends through an opening 23 in the steel jacket. This free end portion of the anchoring member, projecting outwardly from the spacer lug portion 20, has a smaller cross-sectional size, that is, a smaller diameter, than the spacer lug portion. A nut 25 is threaded onto the threaded shank 22 with a washer 24 encircling the threaded shank and spacing the nut 25 from the outer surface of the steel jacket. A protective cover 26 provides a closure over the nut 25. As can be seen in FIG. 3, the depth of insertion of the anchoring member 17 into the plate element extends approximately to the surface of the cooling medium passageways 11 closest to the inner surface of the plate elements, that is, the surface containing the lands 8 and grooves 9.

Figure 4:
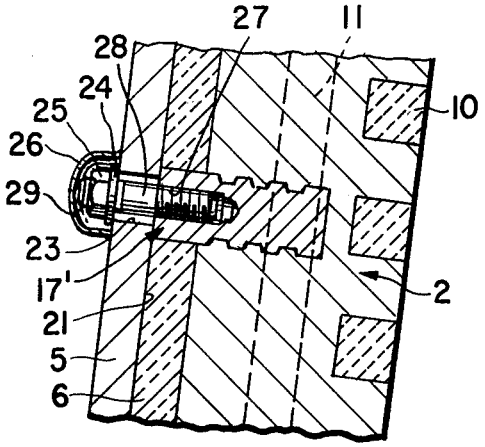
FIG. 4 is a vertical sectional view, on an enlarged scale, of a second embodiment of a fastening member of the cooling device.

In the second embodiment of the anchoring member 17' shown in FIG. 4, the outer contour of the portion of the anchoring member located within the plate member 2 is the same as that shown by the first embodiment in FIG. 3. There is the difference, however, that the spacer lug portion of the anchoring member forms its radially outer end, that is, it does not include an outwardly projecting threaded shank. Rather, instead of the threaded shank, an internal thread is formed in the anchoring member extending through the spacer lug portion into the portion within the plate member. A stud bolt 28 extends from the exterior of the steel jacket 5 through an opening 23 in the steel jacket into the threaded bore formed in the anchoring member. A washer 24 is located between the steel jacket and a nut 25 threaded onto end 29 of the stud bolt located outwardly of the steel jacket. A protective cover 26 encloses the nut.

Figure 5:
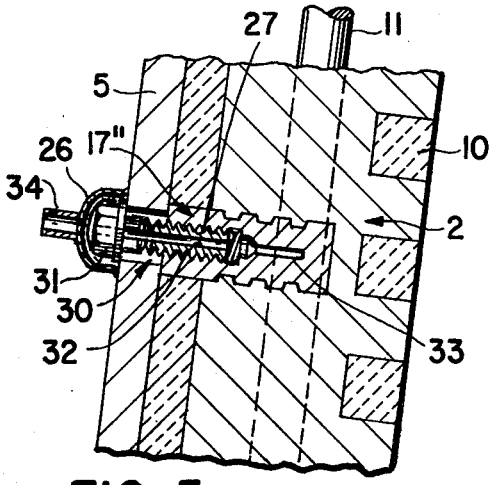
FIG. 5 is a vertical sectional view, on an enlarged scale, of a third embodiment of the fastening member of the cooling device.

In the third embodiment of the anchoring member 17'' illustrated in FIG. 5, a threaded bore 27, similar to that shown in FIG. 4, extends inwardly from the outer end of the spacer lug portion of the anchoring member into the portion of the anchoring member located within the plate member. As distinguished from the second embodiment, however, a fastening screw 30 is used which may be a machine screw with a hexagonal head 31 of a conventional type which is easily available. The fastening screw 30 has a longitudinal bore extending therethrough into a coaxial bore 33 which extends from the threaded bore 27 in the anchoring member 17''. The blind bore 33 is much smaller in diameter than the threaded bore 27. The combination of the bore 32 and the blind bore 33 receives a thermocouple, not shown in detail, which extends into the fastening means through a tubular projection 34 in the protective cover 26 located over the head 31 of the fastening screw on the outside surface of the steel jacket 5. The thermocouple serves to measure the operating temperature of the plate element 2. The inner end of the blind bore 33 is located approximately in the range of the cooling medium passageways 11 through the plate members 2. In the third embodiment displayed in FIG. 5, the anchoring member 17'' within the plate member has the same general arrangement as the first embodiment of FIG. 3.

While specific embodiments of the invention have been shown and described in detail to illustrate the application of the inventive principles, it will be understood that the invention may be embodied otherwise without departing from such principles.

What is claimed is:

1. Cooling device for use in a smelting plant such as in a blast furnace and particularly a shaft furnace, comprising a refractory layer for lining the interior of the furnace, a steel jacket forming the exterior surface of the furnace and spaced outwardly from said refractory layer, plate members including means for circulating a cooling medium through said plate members, said plate members located between said refractory layer and said steel jacekt and each said plate member having an outwardly facing surface directed toward said steel jacket and an inwardly facing surface directed toward said refractory layer, means for fastening said plate members to said steel jacket, wherein the improvement comprises that said fastening means comprise axially extending anchoring members each secured within one said plate member and extending outwardly from the outwardly facing surface of said plate member toward said steel jacket so that said anchoring members extend only from the outwardly facing surfaces of said plate members, and said plate members are cast members and said anchoring members are cast into said plate members.

2. Cooling device, as set forth in claim 1, wherein each said anchoring member has a first axially extending part and a second axially extending part with said first part located within said plate member and having a first end located between the outwardly and inwardly facing surfaces of said plate member and spaced from the inwardly facing surface and a second end located in the plane of the outwardly facing surface of said plate member, and said second part extending from the second end of said first part outwardly toward said steel jacket.

3. Cooling device, as set forth in claim 2, wherein at least an axially extending portion of said second part has a smaller diameter than said first part, said steel jacket having an opening in axial alignment with the smaller diameter portion of said second part, and the smaller diameter portion of said second part extending into the opening in said steel jacket.

4. Cooling device, as set forth in claim 2, wherein said second part of said anchoring member comprises a threaded shank, said steel jacket having an opening in axial alignment with said second part with said threaded shank extending through the opening in said jacket.

5. Cooling device, as set forth in claim 4, wherein said second part of said anchoring member extends through the opening in said steel part and the portion of said second part extending through said jacket is threaded, a nut threaded onto said second part of said anchoring member for securing said jacket to said plate member.

6. Cooling device, as set forth in claim 5, wherein a closure member covers said nut on the outside surface of said steel jacket.

7. Cooling device, as set forth in claim 2, wherein said first and second parts have a blind bore extending from the end of said second part remote from said first part into said first part and terminating short of the first end of said first part.

8. Cooling device, as set forth in claim 7, wherein said blind bore is threaded, a fastening screw threadably engageable with said blind bore and extending outwardly from said second part of said anchoring member for securing said jacket and plate member together.

9. Cooling device, as set forth in claim 8, wherein said blind bore extends axially from the threaded portion thereof toward the first end of said first part.

10. Cooling device, as set forth in claim 9, wherein said fastening screw has an axially extending bore therethrough communicating with the portion of said blind bore extending axially from the threaded portion thereof.

11. Cooling device, as set forth in claim 10, wherein a thermocouple extends through the bore in said fastening screw into the end of said blind bore in said first part of said anchoring member.

12. Cooling device, as set forth in claim 2, wherein said steel jacket is disposed in spaced relation from said plate member, a layer of heat insulating material located in the space between said steel jacket and said plate member, and said second part having a diameter within said heat insulating material equal to the diameter of said first part and the remainder of said second part extending from the portion thereof having the same diameter as said first part having a smaller diameter than said first part, and said second part forming a shoulder at the transition from the diameter of said first part to the smaller diameter and said shoulder disposed in bearing contact with the inwardly facing surface of said steel jacket.

13. Cooling device, as set forth in claim 1, wherein said first part of said anchoring member has alternating annular shaped lands and grooves for providing interlocking engagement with said plate member.

14. Cooling device, as set forth in claim 1, wherein a metallic coating is provided between the exterior surface of said anchoring member and said plate member for forming carbides therebetween during the casting procedure.

15. Cooling device, as set forth in claim 14, wherein said metallic coating is chromium.

16. Cooling device, as set forth in claim 1, wherein adjacent said plate members being spaced apart and the spaces therebetween being filled and sealed with a cement.

17. Cooling device, as set forth in claim 1, wherein said means for circulating a cooling medium comprises passageways extending through said plate members with said passageways spaced outwardly from the inwardly facing surface of said plate member and said anchoring members extending into said plate members for a depth into the range of said passageways extending through said plate member.

* * * * *